US008579531B2

(12) United States Patent
Maelstaf et al.

(10) Patent No.: US 8,579,531 B2
(45) Date of Patent: Nov. 12, 2013

(54) DEVICE FOR DISPENSING A COSMETIC PRODUCT AND ASSOCIATED STORAGE METHOD

(75) Inventors: Luc Maelstaf, Bois Colombes (FR); Patrice Brunerie, Tremblay en France (FR)

(73) Assignee: L'Oreal, Paris (FR)

( * ) Notice: Subject to any disclaimer, the term of this patent is extended or adjusted under 35 U.S.C. 154(b) by 687 days.

(21) Appl. No.: 12/718,580

(22) Filed: Mar. 5, 2010

(65) Prior Publication Data

US 2010/0226707 A1 Sep. 9, 2010

Related U.S. Application Data

(60) Provisional application No. 61/166,270, filed on Apr. 3, 2009.

(30) Foreign Application Priority Data

Mar. 6, 2009 (FR) ..... 09 51434

(51) Int. Cl.
*B43K 23/08* (2006.01)

(52) U.S. Cl.
USPC ..... 401/213; 401/209

(58) Field of Classification Search
USPC ..... 401/213, 209, 219, 220
See application file for complete search history.

(56) References Cited

U.S. PATENT DOCUMENTS

| | | | | |
|---|---|---|---|---|
| 2,719,997 | A | 7/1952 | Ackerman | |
| 4,030,844 | A * | 6/1977 | Lench et al. | 401/213 |
| 5,248,213 | A * | 9/1993 | Seager et al. | 401/213 |
| 5,362,169 | A * | 11/1994 | Hamamoto et al. | 401/213 |
| 5,462,379 | A * | 10/1995 | Masumoto et al. | 401/213 |
| 6,511,243 | B2 | 1/2003 | Miranda | |
| 2004/0253044 | A1 * | 12/2004 | Miranda | 401/209 |

FOREIGN PATENT DOCUMENTS

WO 2006/007987 1/2006

* cited by examiner

*Primary Examiner* — David Walczak
*Assistant Examiner* — Bradley Oliver
(74) *Attorney, Agent, or Firm* — Novak Druce Connolly Bove + Quigg LLP

(57) ABSTRACT

This device comprises a container (12), a head (14) which is for dispensing cosmetic product and which is provided with a rotary application member (44) and a retention cap (42).
It comprises a blocking cover (16) which can be moved between a position for blocking the container (12) and a position for dispensing the product.
The container (12) is shaped so as to prevent the device (10) from being retained in a stable manner on a horizontal support with the head (14) in an upward position.
The cover (16) comprises a member (86) for urging the rotary application member (40) against a sealing seat (60) delimited by the cap (42) in the blocking position of the cover.
The urging member (86) can be resiliently deformed relative to the cover (16) between an idle configuration and a resiliently deformed configuration.

14 Claims, 3 Drawing Sheets

DEVICE FOR DISPENSING A COSMETIC PRODUCT AND ASSOCIATED STORAGE METHOD

The present invention relates to a device for dispensing a cosmetic product, of the type comprising:

a container which extends along an axis and which delimits, for the cosmetic product, a reservoir which opens via a dispensing opening, a head which is for dispensing cosmetic product and which blocks the dispensing opening, the head comprising a rotary application member and a retention cap which receives the rotary application member so as to rotate freely about at least one axis of rotation;

a blocking cover which delimits a space for receiving the head, the cover being able to be moved between a position for blocking the container in which the head is received in the receiving space and a position for dispensing the product, the container being shaped so as to prevent the device from being retained in a stable manner on a horizontal support with the head in an upward position, the cover comprising a wall for stable retention of the device on a horizontal support with the head in a downward position and a member for urging the rotary application member against a sealing seat which is delimited by the cap in the position for blocking the container.

The term "cosmetic product" is intended in particular to refer to a product as defined in the EC Council Directive 93/55 of 14 Jun. 1993.

Such a device is intended to dispense a cosmetic product for application to the skin or the keratin fibres of a user.

It generally comprises a container which receives the cosmetic product and, for dispensing the product, a head which comprises a rotary application member, such as a ball or a small roller, mounted in a cap at one end of the container.

The cosmetic product is applied by rotating the rotary application member in the cap by means of contact with the skin or the keratin fibres of the user. The product is discharged from the container, passing between the rotary application member and the cap.

When the user has finished using the device, he places a cover on the container around the dispensing head in order to block it.

WO 2006/007987 and U.S. Pat. No. 6,511,243 describe dispensing devices of the above-mentioned type. In these devices, the container and the cover are shaped so that the device is stored vertically on a horizontal support with the dispensing head thereof in a downward position.

The container is thus shaped with a base wall which prevents the stable retention of the device with the head in an upward position, whilst the cover defines a wall for stable retention of the device on a horizontal support with the head in a downward position.

In these devices, the cosmetic product is capable of flowing between the rotary application member and the cap during storage, which may lead to leakages and losses of the product which are undesirable and costly for the user.

In order to overcome this problem, WO 2006/007987 and U.S. Pat. No. 6,511,243 make provision for the cover to be provided with rigid lugs for pressing the rotary application member against a sealing seat defined by the cap. However, these lugs are effective only when the cover is screwed in a secure manner in a locked position on the container.

However, leakages of cosmetic product from the container may still occur if the user closes the cover incorrectly, in particular owing to a lack of time or force.

U.S. Pat. No. 2,719,997 discloses another dispensing device.

An object of the invention is therefore to provide a device which is for dispensing cosmetic product, which comprises a rotary application member and which may be stored with the head in a downward position, with a very limited risk of leakage of cosmetic product during storage.

To this end, the invention relates to a device of the above-mentioned type, characterised in that the urging member can be resiliently deformed relative to the cover between an idle configuration which it occupies in the position for dispensing the product and a resiliently deformed configuration which it occupies in the position for blocking the container.

The device according to the invention may comprise one or more of the following features, taken in isolation or in accordance with any technically possible combination:

the urging member is at least partially deformed as soon as the container is arranged with the head in a downward position in the cover when the cover occupies a stable position on a horizontal support, regardless of the angular position of the dispensing head relative to the cover about the axis;

the cover can be moved axially along the axis of the container between an initial position for engagement around the head, in which the head is partially received in the inner space, and the blocking position, the urging member being resiliently deformed over the entire axial path of the cover from the initial engagement position thereof to the blocking position;

the urging member is arranged in the inner space, axially remote from the retention wall, without any contact with the retention wall;

the urging member comprises a base which is fixedly joined to a wall of the cover and at least one resiliently deformable lug which protrudes relative to the base;

the urging member comprises at least one resiliently deformable base and a member for contact on the rotary application member which is fixedly joined to the base;

the base is formed by a dome;

the urging member is attached to a wall of the cover;

the urging member is integral with at least one wall of the cover;

the device comprises a mechanism for locking the cover in a locked blocking position;

the locking mechanism comprises at least one pin which is fixedly joined to one of the cover or a fixed element which is formed by one of the container or the head, the locking mechanism comprising a guide for receiving the pin which is fixedly joined to the other of the cover or the fixed element, the cover being mounted rotatably about the axis of the container relative to the fixed element when the cover moves from the dispensing position to the locked blocking position thereof; and at least one of the guide or the pin delimits a cam surface which is capable of axially moving the cover relative to the container along the axis of the container when the cover is rotated relative to the container about the axis of the container.

The invention also relates to a method for storing a device for dispensing a cosmetic product, characterised in that it comprises the following steps:

providing a device as defined above, the cover being in the dispensing position of the device;

moving the cover from the dispensing position to the blocking position thereof, the movement involving pressing the urging member against the rotary application member and resiliently deforming the urging member between the idle configuration and the deformed configuration thereof in order to press the rotary application member against the sealing seat;

arranging the retention wall on a support, the device being held in a stable manner on the support with the head in a downward position.

The invention will be better understood from a reading of the following description, given purely by way of example, and with reference to the appended drawings, in which.

A first device 10 for applying a cosmetic product according to the invention is illustrated in FIGS. 1 to 4.

Figure 2:
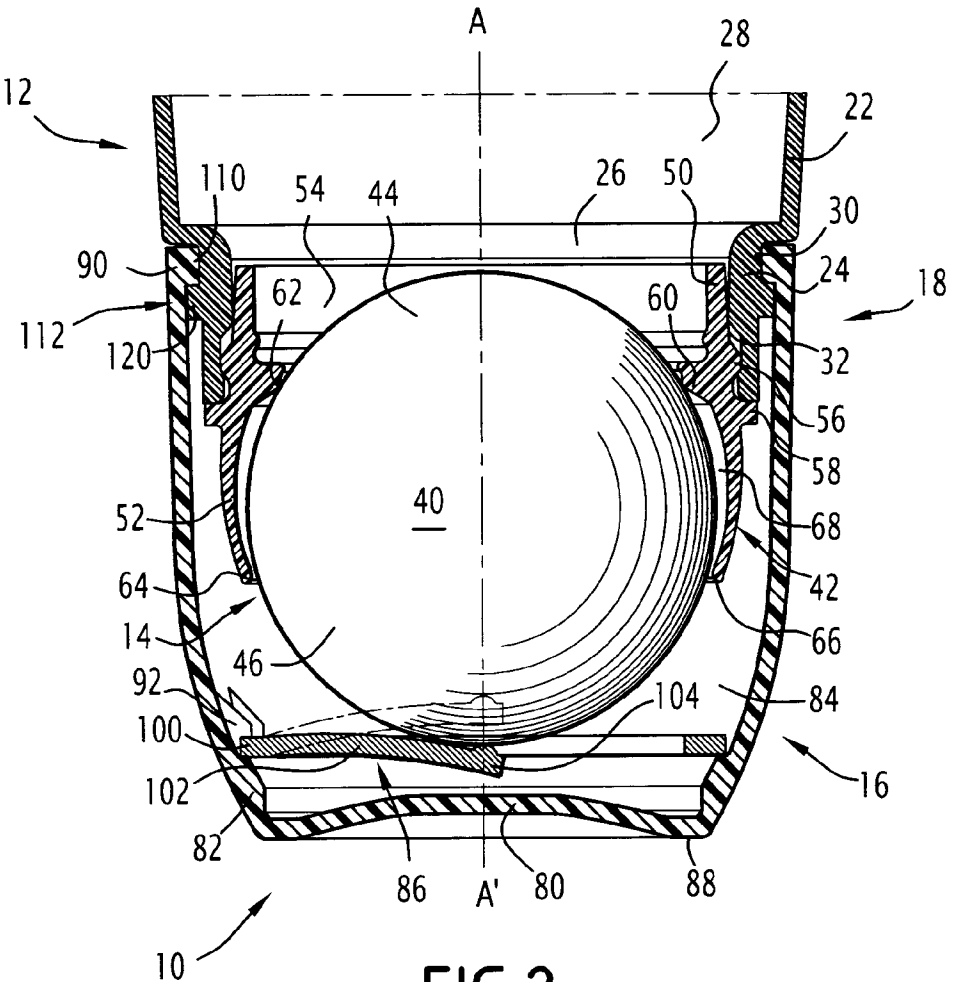
FIG. 2 is a sectioned view along the vertical centre plane II of FIG. 1.

This device 10 comprises an elongate container 12 which receives the cosmetic product to be applied, an application assembly which is formed by a dispensing head 14 which can be seen in FIG. 2, a removable cover 16 for blocking the head 14 and a mechanism 18 for locking the cover 16 on the container.

The cosmetic product contained in the container is advantageously a liquid, an emulsion, a cream or a gel. In a variant, this product is a fluid powder.

This product is advantageously an anti-perspirant, an anti-odour and/or scented product in order to constitute a deodorant or a perfume.

Figure 1:
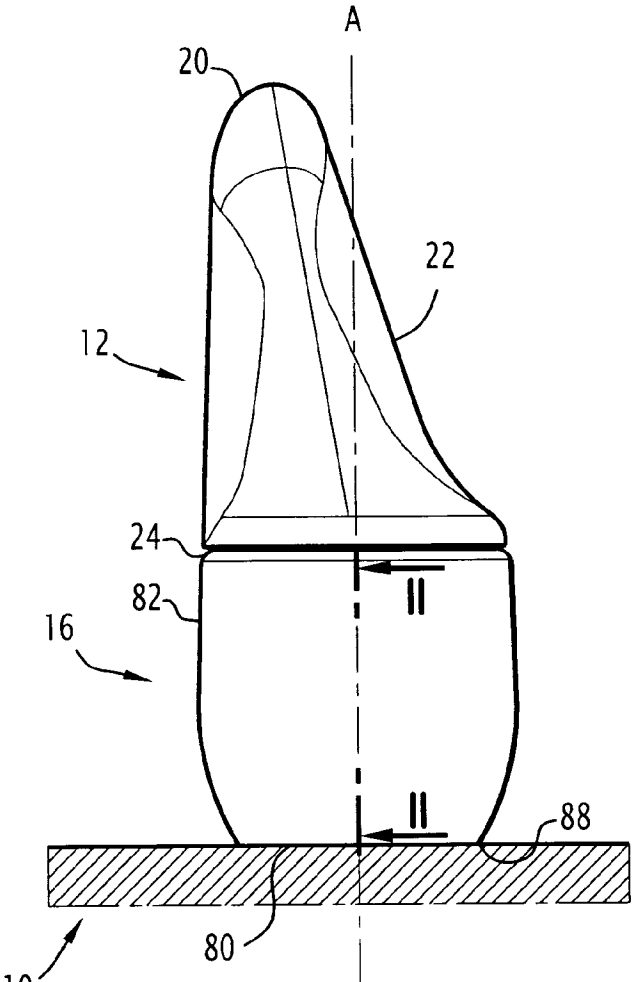
FIG. 1 is a side elevation view of a first application device according to the invention arranged in stable abutment on a support with the head in a downward position.

As illustrated in FIGS. 1 and 2, the container 12 extends along an axis of the container A-A', that is vertical in FIG. 1.

The container 12 comprises, from top to bottom in FIG. 1, a base wall 20, a lateral wall 22 and, for mounting the head 14, a neck 24 which opens via an opening 26 for dispensing the product, which can be seen in FIG. 2.

The base wall 20, the lateral wall 22 and the neck 24 internally define, for the cosmetic product, a reservoir 28 which opens exclusively via the dispensing opening 26.

The base wall 20 is shaped so as to prevent stable retention of the device 10 with the head 14 in an upward position, with the axis A-A' of the container substantially vertical, when the base wall 20 is placed on a horizontal support.

To this end, the base wall 20 is rounded or curved with a concavity which is directed away from the dispensing opening 26. It does not extend in a horizontal plane.

In this example, the lateral wall 22 has a shape which diverges away from the base wall 20. It defines with the neck 24 an external peripheral shoulder 30 for blocking the cover 16. The lateral wall 22 can be gripped by the hand of a user in order to apply cosmetic product.

The neck 24 protrudes from the shoulder 30 along the axis A-A' towards the cover 16. It has a maximum width, when viewed perpendicularly relative to the axis A-A', which is less than the maximum width of the lateral wall 22 in the region of the shoulder 30.

The neck 24 internally defines an annular peripheral groove 32 for force-mounting the head 14.

The application head 14 comprises a rotary application member 40 for application of the product and, for retaining the rotary application member 40, a cap 42 which rotatably receives this member 40.

The rotary application member 40 in this example is formed by a rotary ball. In a variant, the rotary application member 40 is formed by a roll or small roller which is rotatably mounted in the cap 42.

The rotary application member 40 has an outer portion 44 which protrudes from the cap 42 so as to be pressed against the skin and/or the keratin fibres of a user, and an inner portion 46 which is received in the cap 42.

The application member 40 is mounted so as to freely rotate about at least one axis which is perpendicular relative to the axis A-A' in the cap 42.

In this example, the rotary application member 40 formed by a ball is mounted so as to freely rotate in accordance with a plurality of axes of rotation which are perpendicular relative to the axis A-A'. It forms a ball-and-socket joint with the cap 42.

The diameter of the rotary application member 40 is slightly less, for example, a maximum of 20% less, than the diameter of the neck 24.

The cap 42 comprises, from top to bottom in FIG. 1, an inner sleeve 50 for mounting on the neck and an outer skirt 52 for retaining the rotary application member 40. The sleeve 50 and the skirt 52 delimit, for dispensing the product, a central channel 54 having an axis A-A', into which the rotary application member 40 is inserted.

The sleeve 50 is substantially cylindrical with an axis A-A'. It has externally a flange 56 for force-mounting in the neck 24, and a rib 58 for abutment against the outer edge of the neck 24. The sleeve 50 has internally an annular sealing seat 60 which is intended to receive the inner portion 46 of the rotary application member 40.

The mounting flange 56 is engaged with force in the groove 32. The support rib 58 rests in abutment against the outer edge of the neck 24 externally relative to the flange 56. In this manner, the cap 42 is fixedly joined to the container 12. In a variant, the cap 42 is integral with the container 12.

The annular seat 60 defines a peripheral shoulder 62 which has a contour identical to the outer contour of a cross-section of the lower portion 46, this cross-section being less than the maximum cross-section of the rotary application member 40.

The seat 60 protrudes radially towards the axis A-A' in the central channel 54.

The outer skirt 52 protrudes externally from the sleeve 50 along the axis A-A' over a height which is less than the height of the ball 40. It extends as far as a free edge 64 and converges in a curved manner towards the axis A-A'.

The outer skirt 52 is solid along the periphery thereof and defines along the free edge 64 an opening 66 for passage of the rotary application member 40.

The outer cross-section of the passage opening 66, when viewed perpendicularly relative to the axis A-A', is less than the maximum cross-section of the rotary application member 40.

The channel 54 extends axially between the reservoir 28 and the passage opening 66 into which it opens.

The rotary application member 40 is mounted so as to rotate freely in the channel 54. The inner portion 46 of the rotary application member and the opposing skirt 52 together delimit, for dispensing the product, an annular passage 68 located at the periphery of the channel 54.

The rotary application member 40 can be moved along the axis A-A' in the channel 54 between an internal position for blocking the annular passage 68 and an external position for dispensing liquid through the passage 68.

In the internal position, the lower portion 46 of the rotary application member 40 is arranged in abutment against the shoulder 62 of the seat 60 in order to block the reservoir 28 in a substantially sealed manner towards the outer side and to prevent the movement of cosmetic product through the passage 68.

In the external position, the cosmetic product is free to flow, at the periphery of the rotary application member 40, into the passage 68 which is open, from the reservoir 28, through the channel 54, as far as the opening 66.

The cover 16 comprises a base wall 80 and a lateral wall 82 which protrudes towards the container 12 from the base wall 80, the walls 80 and 82 defining an inner space 84 for receiving the head 14.

The cover 16 further comprises, according to the invention, a resiliently deformable member 86 for urging the rotary application member 40 against the seat 60.

The base wall 80 delimits a planar external abutment surface 88 which extends at the periphery of this wall 80.

This surface 88 is shaped in order to allow the device 10 to be retained in a stable manner, with the head 14 in a downward position and the axis A-A' substantially vertical, when the abutment surface 88 is pressed against the horizontal support, as illustrated in FIG. 1. The base wall 80 thus forms a wall for retaining the device 10 in a stable manner with the head 14 in a downward position.

The lateral wall 82 has a height, when viewed along the axis A-A', greater than the maximum height of the head 14.

The lateral wall 82 protrudes about the axis A-A' from the base wall 80 as far as an inner edge 90. It defines, in the region of and axially remote from the base wall 80, cross-members 92 for mounting and axially retaining the urging member 86. The cross-members 92 are integral with the wall 82 and protrude radially towards the axis A-A' in the inner space 84.

The free edge 90 defines, for inserting the head 14, an opening having a cross-section which is greater than the maximum cross-section of the head 14. The free edge 90 has an outer contour which is slightly less than the outer contour of the lateral wall 22 in the region of the shoulder 30.

Figure 4:
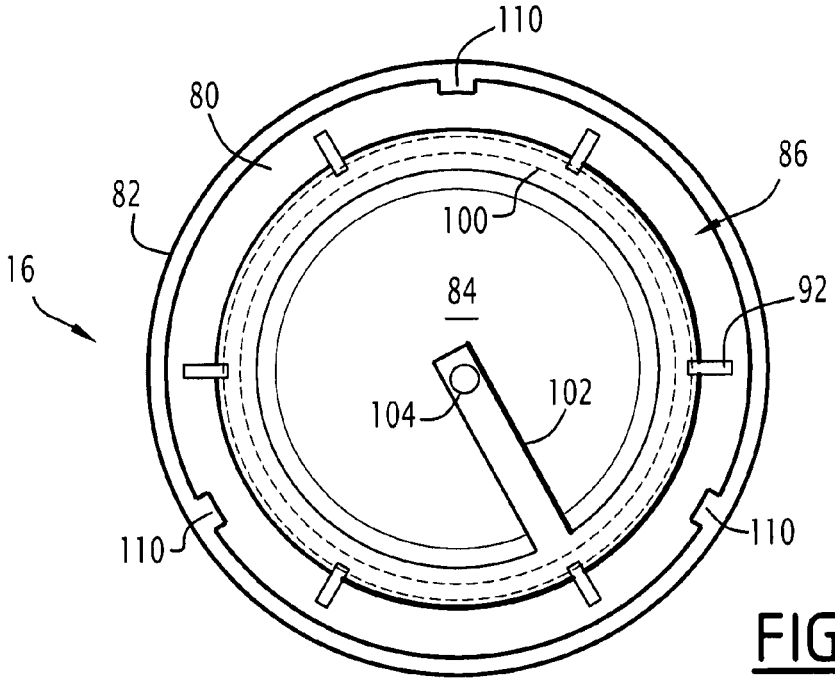
FIG. 4 is a plan view of the inner space of the cover of the device of FIG. 1.

As illustrated in FIGS. 2 and 4, the urging member 86 comprises an annular base 100 which is fixedly joined to the lateral wall 82 and at least one resiliently deformable urging lug 102 which protrudes radially towards the axis A-A' relative to the base 100.

More generally, the number of lugs 102 is greater than or equal to 1 and is advantageously between 1 and 6.

In this example, the urging member 86 is fitted in the cover 16 to the lateral wall 82. In a variant, the member 86 is integral with the cover 16.

This member 86 is advantageously formed of acetal or another material which allows the appropriate resilient effect to be achieved.

In a variant, this member 86 is a metal spring.

The base 100 is fixed in the wall 82 by means of insertion between the cross-members 82. It is fixed axially along the axis A-A'.

The lug 102 has, at the free end 104 thereof, a stud for pressing against the rotary application member 40.

The lug 102 can be deformed by means of flexion between an idle configuration which is illustrated with broken lines in FIG. 2, in which it protrudes remote from the base wall 80 towards the free edge 90, and a deformed configuration in which it protrudes remote from the free edge 90 towards the base wall 80.

In the idle configuration, the lug 102 protrudes towards the free edge 90 relative to the centre plane of the base 100.

In the deformed configuration, the free end 104 is located substantially in the centre plane of the annular base 100.

The locking mechanism 18 is of the "bayonet" type. It thus comprises a plurality of locking pins 110 which are distributed at the periphery of the cover 16 and, for each pin 110, a corresponding guide 112 which is arranged at the periphery of the container 12 on the neck 24.

The pins 110 protrude radially towards the axis A-A' relative to the lateral wall 82 in the region of the edge 90.

In the example illustrated in FIG. 2, the number of pins is 3. More generally, this number is between 2 and 4.

The guides 112 are distributed at the periphery of the neck about the axis A-A', together defining spaces 118 for axially inserting the pins 110. The number of guides 112 is equal to the number of pins 110.

Each guide 112 comprises a circumferential rib 120 and a base stop 122.

The rib 120 extends substantially parallel with the shoulder 30 and opposite thereto. It protrudes radially away from the axis A-A' from the neck 24. Each rib 120 defines, at a free end, located in a space 118, an inclined cam surface 124 which is capable of co-operating with the pin 110.

The base stop 122 connects the rib 120 to the shoulder 30 and extends axially.

The rib 120, the base stop 122 and the shoulder 30 together define, for insertion of the pin 110, a circumferential groove 126 which has a height which is substantially equal to the height of the pin 110.

Figure 3:
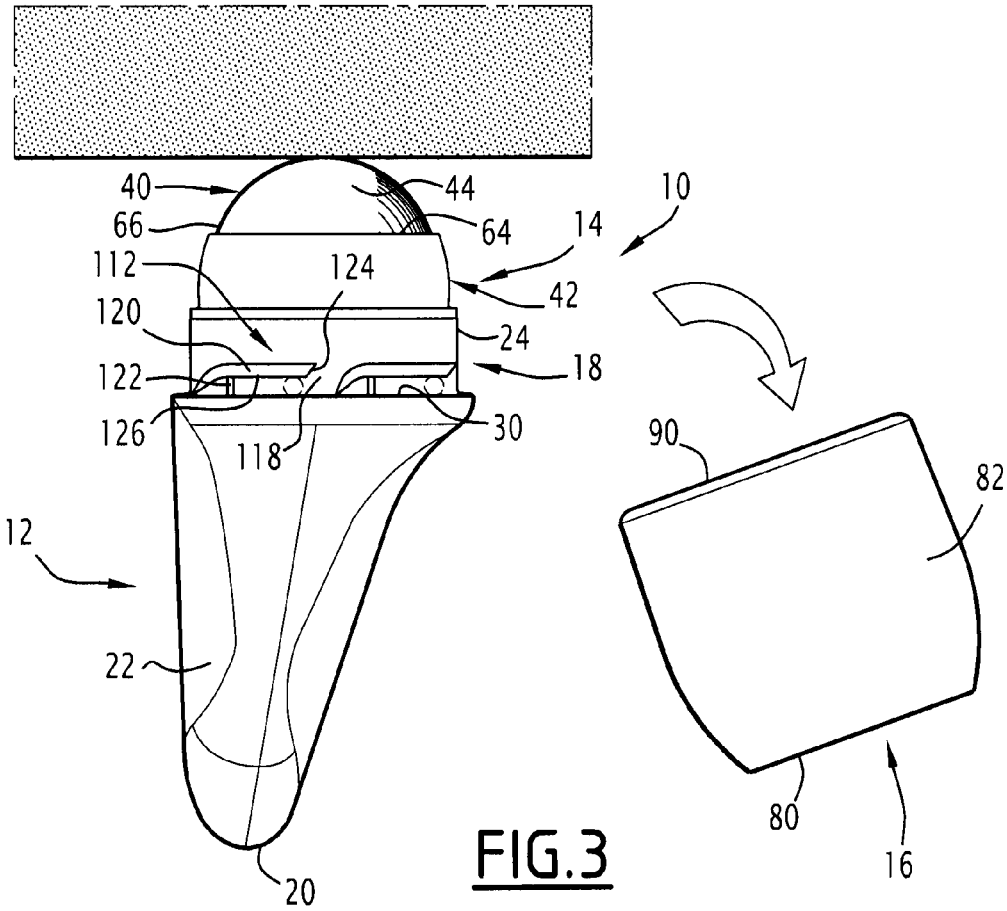
FIG. 3 is a view similar to FIG. 1 during the application of cosmetic product, with the protective cover in the dispensing position.

The cover 16 can be moved relative to the container 12 and to the head 14 between a position for dispensing the product 10, illustrated in FIG. 3, an initial position for engagement of the head, an intermediate blocking position engaged around the head 14, and a position for locked blocking of the container 12, illustrated in FIGS. 1 and 2.

In the position for use, the cover 16 is arranged completely remote from the head 14 and the container 12. The head 14 has been removed from the inner space 84. The urging member 86 is in the idle configuration thereof.

In the initial engagement position, the head 14 has been introduced at least partially in the space 84 along the axis A-A'. The urging member 86 is in the idle configuration thereof. The free end 104 is pressed against the rotary application member 40.

In the intermediate blocking position, the cover 16 has been moved along the axis A-A' in order to move the urging member 86 from the idle configuration to the deformed configuration thereof. The urging member 86 retains the rotary application member 40 in the internal position thereof, pressed against the seat 60.

In the locked blocking position, the pins 110 are moved into the spaces 118 and the cover 16 has then been pivoted about the axis A-A' so as to insert the pins 110 into the grooves 116 defined by the guides 112.

Each pin 110 can thus be moved about the axis A-A' when the cover 16 is rotated along the rib 120 and the cam surface 124 as far as a position in abutment against the base stop 122. The co-operation between each pin 110 and the cam surface 124 moves the cover 16 and the shoulder 30 axially closer together, further increasing the deformation of the urging member 86.

The head 14 and the neck 24 are received in the inner space 84. The cover 16 is flush with the lateral wall 22 of the container 12 along the shoulder 30.

It should be noted that, regardless of the total weight of the container 12 including the product which it contains, the deformation will be the same in the locked blocking position. In the intermediate blocking position, the deformation rate of the urging member 68 will depend on the weight applied by the container 12 and therefore the development of the volume of product contained in this container 12 to the urging member 68.

The operation of the first device 10 according to the invention will now be described.

Initially, as illustrated in FIG. 3, the cover 16 is placed in the dispensing position, remote from the container 12. The outer portion 44 of the rotary application member 40 is placed in contact with the skin or the keratin fibres of a user and is moved in order to allow the product to be applied.

In this manner, the rotary application member 40 rolls on the skin or the keratin fibres. During this rolling action, the rotary application member 40 is placed remote from the internal position thereof, which allows cosmetic product to pass from the reservoir 28, through the dispensing opening 26, then into the channel 54 as far as the passage opening 66.

When the user has finished applying the product, he moves the cover 16 successively into the initial engagement position thereof then into the intermediate blocking position thereof.

To this end, he inserts the head 14 and a portion of the neck 24 into the inner space 84, moving the pins 110 opposite the spaces 118 for axial passage. Then, he axially moves the cover 16 towards the container 12 by moving the free edge 90 towards the shoulder 30.

During this movement, the free end 104 of the deformable lug 102 of the urging member 86 presses against the rotary application member 40 in the initial engagement position and becomes deformed resiliently towards the deformed configuration in the intermediate blocking position.

The urging member 86 applies, via the lug 102, a force for urging the rotary application member 40 towards the internal position thereof pressed against the sealing seat 60. This blocks the annular passage 68 for circulation of cosmetic product.

This blocking is carried out just after the resilient urging member 86 comes into contact with the rotary application member 40 without it being necessary for the cover 16 to be completely locked on the container 12. In this manner, even if the user inadequately locks the cover 16 on the container 12, the risk of product leaking from the reservoir 28 through the head 14 is very limited.

This is particularly true when the user places the container 12 with the head in the downward position in the cover 16, the cover 16 being arranged in a stable manner on a horizontal surface, regardless of the angular position of the dispensing head relative to the cover 16 about the axis A-A'. In this manner, the urging member 68 is deformed even when the pins 110 are placed angularly remote from the spaces 118 and axially abut above the ribs 120 outside the groove 126.

Then, the user rotatably moves the cover 16 about the axis A-A' in order to cause the pins 110 to penetrate into the grooves 126 defined by the guides 112. During this movement, the pins 110 co-operate with the cam surface 124, which brings about an axial movement of the cover 16 towards the container 12 and therefore more secure locking of the cover 16 on the container 12.

During this movement, the deformation of the resilient lug 102 of the urging member 86 continues in order to reach the deformed configuration. The cover 16 is fixed relative to the container 12.

The device 10 is then turned with the head 14 downwards in order to press in a stable manner the abutment surface 88 of the base wall 80 of the cover 16 on a planar support, as illustrated in FIG. 1. The axis A-A' of the container extends substantially vertically in a stable manner. The base wall 80 of the container 12 is arranged remote from the planar support.

The weight of the cosmetic product contained in the reservoir 28, for example, between 50 g and 75 g, brings about a force which is directed downwards and which presses on the assembly formed by the container 12 and the head 14. This force further promotes the locking of the container 12 on the cover 16.

This force prevents the product from being discharged when the container 12 is not yet locked on the cover 16, the container being presented with the head in a downward position.

The presence of the urging member 86, which acts counter to this force, ensures that the sealing in the region of the seat 60 is adequately maintained, which prevents cosmetic product from leaking through the head 14 when it is stored with the head in a downward position.

Figure 5:
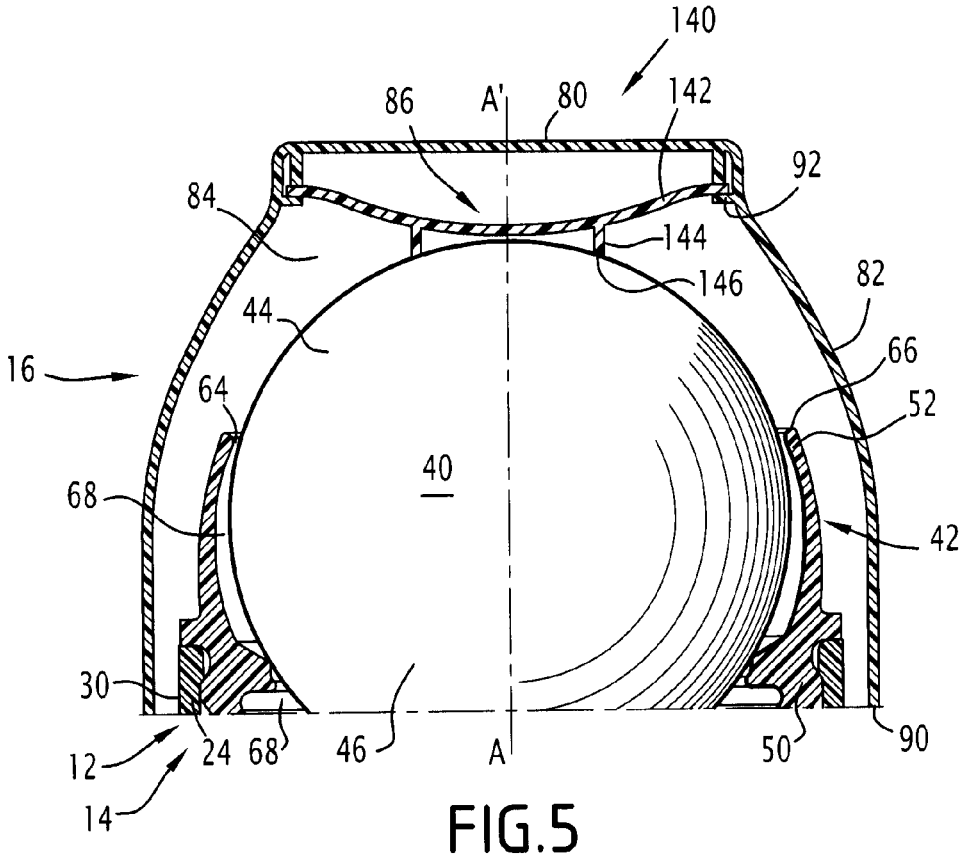
FIG. 5 is a view similar to FIG. 2 of a second device according to the invention, in a position in which the cover is engaged on the container.
Figure 6:
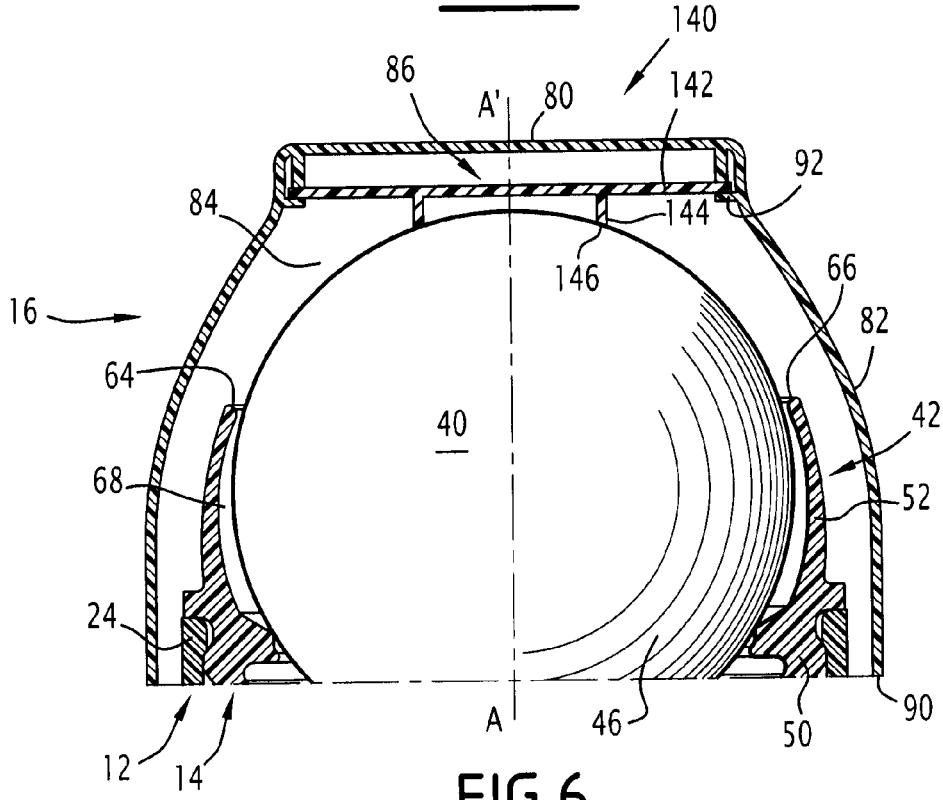
FIG. 6 is a view similar to FIG. 5, the cover being in its locked blocking position.

A second device 140 according to the invention is illustrated in FIGS. 5 and 6.

In contrast to the first device 10, the urging member 86 of the second device 140 comprises a base which is formed by a resiliently deformable dome 142 and an annular sleeve 144 for abutment against the rotary application member 40 which is not necessarily deformable.

The dome 142 is fixed at the periphery thereof to the lateral wall 82. The sleeve 144 protrudes from the dome 142 towards the free edge 90 about the axis A-A'. In this example, it is integral with the dome 142. It defines a continuous free edge 146 over a circumference for contact with the rotary application member 40.

In the idle configuration, illustrated in FIG. 5, the dome 142 protrudes remote from the base wall 80 with a concavity which is directed towards the free edge 90.

In the deformed configuration, illustrated in FIG. 6, the dome 142 has been deformed towards the base wall 80 and has a substantially planar configuration in a plane perpendicular to the axis A-A'.

The operation of the second device 140 is further similar to that of the first device.

In a variant of this embodiment, the sleeve 144 is replaced by at least one discontinuous lug over a circumference about the axis A-A'.

In a variant of the first device 10 and the second device 140, the cover 16 is formed by a plurality of components, for example, a component which forms the base wall 80 and another component which forms the lateral wall 82, the components being assembled together.

In another variant, the urging member 86 is formed by a deformable portion of the base wall 80.

More generally, the locking mechanism 18 can be of the screw or snap-fitting type, the cover 16 not necessarily rotating about the axis A-A' in order to move into the locked blocking position.

The invention claimed is:

1. Device (10; 140) for dispensing a cosmetic product, of the type comprising:

a container (12) which extends along an axis (A-A') and which delimits, for the cosmetic product, a reservoir (28) which opens via a dispensing opening (26), a head (14) which is for dispensing cosmetic product and which blocks the dispensing opening (26), the head (14) comprising a rotary application member (44) and a retention cap (42) which receives the rotary application member (44) so as to rotate freely about at least one axis of rotation;

a blocking cover (16) which delimits a space (84) for receiving the head (14), the cover (16) being able to be moved between a position for blocking the container (12) in which the head (14) is received in the receiving space (84) and a position for dispensing the product, the container (12) being shaped so as to prevent the device (10) from being retained in a stable manner on a horizontal support with the head (14) in an upward position, the cover (16) comprising a wall (80) for stable retention of the device (10) on a horizontal support with the head (14) in a downward position and a member (86) for urging the rotary application member (40) against a sealing seat (60) which is delimited by the cap (42) in the position for blocking the container;

wherein the urging member (86) is configured to be resiliently deformed relative to the cover (16) between an idle configuration which it occupies in the position for dispensing the product and a resiliently deformed configuration which it occupies in the position for blocking the container, and wherein the urging member (86) is at least partially deformed as soon as the container (12) is arranged with the head in a downward position in the cover (16), when the cover (16) occupies a stable position on a horizontal support, regardless of the angular position of the dispensing head (14) relative to the cover (16) about the axis (A-A');

wherein the rotary application member (40) can be moved along the axis (A-A') of the head in a channel (54) between an internal position for blocking an annular passage (68) defined between the head and the rotary application member and an external position for dispensing product;

wherein in the internal position, the rotary application member (40) blocks the reservoir (28) in a substantially sealed manner towards the outside of the device, and wherein in the external position, the cosmetic product is free to flow from the reservoir (28), towards the outside of the device.

2. Device (10; 140) according to claim 1, wherein the urging member (86) is arranged in the inner space (84), axially remote from the retention wall (80).

3. Device (10) according to any one of claim 1 or 2, wherein the urging member (86) comprises a base (100) which is fixedly joined to a wall (82) of the cover and at least one resiliently deformable lug (102) which protrudes relative to the base (100).

4. Device (140) according to any one of claim 1 or 2 wherein the urging member (86) comprises at least one resiliently deformable base (142) and a member (144) for contact on the rotary application member (40) which is fixedly joined to the base (100).

5. Device (140) according to claim 4, wherein the base (142) is formed by a dome.

6. Device (10; 140) according to any one of claim 1 or 2, wherein the urging member (86) is attached to a wall (82) of the cover (16).

7. Device according to any one of claim 1 or 2, wherein the urging member (86) is integral with at least one wall (82) of the cover (16).

8. Device (10; 140) according to any one of claim 1 or 2, wherein it comprises a mechanism (18) for locking the cover (16) in a locked blocking position.

9. Device (10; 140) according to claim 8, wherein the locking mechanism (18) comprises at least one pin (110) which is fixedly joined to one of the cover or a fixed element which is formed by one of the container (12) or the head (14), the locking mechanism (18) comprising a guide (112) for receiving the pin (110) which is fixedly joined to the other of the cover (16) or the fixed element, the cover (16) being mounted rotatably about the axis (A-A') of the container relative to the fixed element when the cover (16) moves from the dispensing position to the locked blocking position thereof.

10. Device according to claim 9, wherein at least one of the guide (112) or the pin (110) delimits a cam surface (124) which is capable of axially moving the cover (16) relative to the container (12) along the axis (A-A') of the container when the cover (16) is rotated relative to the container (12) about the axis (A-A') of the container.

11. Method for storing a device (10; 140) for dispensing a cosmetic product, comprising the following steps:

providing a device (10; 140) according to any one of claim 1 or 2, the cover (16) being in the dispensing position of the device;

moving the cover (16) from the dispensing position to the blocking position thereof, the movement involving pressing the urging member (86) against the rotary application member (40) and resiliently deforming the urging member (86) between the idle configuration and the deformed configuration thereof in order to press the rotary application member (40) against the sealing seat (60);

arranging the retention wall (80) on a support, the device (10; 140) being held in a stable manner on the support with the head (14) in a downward position.

12. Device (10; 140) for dispensing a cosmetic product, of the type comprising:

a container (12) which extends along an axis (A-A') and which delimits, for the cosmetic product, a reservoir (28) which opens via a dispensing opening (26), a head (14) which is for dispensing cosmetic product and which blocks the dispensing opening (26), the head (14) comprising a rotary application member (44) and a retention cap (42) which receives the rotary application member (44) so as to rotate freely about at least one axis of rotation;

a blocking cover (16) which delimits a space (84) for receiving the head (14), the cover (16) being able to be moved between a position for blocking the container (12) in which the head (14) is received in the receiving space (84) and a position for dispensing the product, the container (12) being shaped so as to prevent the device (10) from being retained in a stable manner on a horizontal support with the head (14) in an upward position, the cover (16) comprising a wall (80) for stable retention of the device (10) on a horizontal support with the head (14) in a downward position and a member (86) for urging the rotary application member (40) against a sealing seat (60) which is delimited by the cap (42) in the position for blocking the container;

wherein the urging member (86) is configured to be resiliently deformed relative to the cover (16) between an idle configuration which it occupies in the position for dispensing the product and a resiliently deformed configuration which it occupies in the position for blocking the container, and wherein the urging member (86) is at least partially deformed as soon as the container (12) is arranged with the head in a downward position in the cover (16), when the cover (16) occupies a stable position on a horizontal support, regardless of the angular position of the dispensing head (14) relative to the cover (16) about the axis (A-A');

wherein urging member (86) comprises at least one resiliently deformable base (142) and a member (144) for contact on the rotary application member (40) which is fixedly joined to the base (100); and wherein the base (142) is formed by a dome.

13. Device according to claim 12, for dispensing a deodorant and/or antiperspirant.

14. Device according to claim 1, for dispensing a deodorant and/or antiperspirant.

* * * * *